United States Patent [19]

Dieter, Jr.

[11] 3,952,171

[45] Apr. 20, 1976

[54] STEREO PHONOGRAPH CARTRIDGE

[75] Inventor: Norman H. Dieter, Jr., Pleasantville, N.Y.

[73] Assignee: Micro/Acoustics Corporation, Elmsford, N.Y.

[22] Filed: Sept. 18, 1974

[21] Appl. No.: 507,202

[52] U.S. Cl. ..... 179/100.41 K; 179/100.41 P; 274/37

[51] Int. Cl.[2] ..... H04R 1/16

[58] Field of Search ..... 179/100.41 P, 100.41 B, 179/100.41 K; 274/37

[56] References Cited

UNITED STATES PATENTS

| | | | |
|---|---|---|---|
| 2,849,239 | 8/1958 | Dieter et al. | 274/37 |
| 3,055,989 | 9/1962 | Bachman et al. | 179/100.41 K |
| 3,219,764 | 11/1965 | Pritchard | 274/37 |
| 3,646,279 | 12/1970 | Stanton | 274/37 |
| 3,673,354 | 6/1972 | Oda et al. | 179/100.41 K |
| 3,720,796 | 3/1973 | Honma | 274/37 |

*Primary Examiner*—Richard E. Aegerter
*Assistant Examiner*—John W. Shepperd
*Attorney, Agent, or Firm*—Kenyon & Kenyon Reilly Carr & Chapin

[57] ABSTRACT

An improved stereo phonograph cartridge which provides direct coupling between the stylus signal motion and right and left channel transducers with minimal distortion of the record groove modulation in which the transducers are held between elastomeric blocks with forces transmitted to the transducers by horizontally spaced contact points on a resolver on which the stylus bar is supported and which is anchored to the base with a flexible pivot anchor under tension with the resolver having a pair of stabilizers of an elastomeric material located in vertical alignment with the contact points on the resolver to form a second set of force transmission points with all points equidistant from the pivot point of the pivot anchor to result in a balanced arrangement such that right and left channel stylus bar motions will be faithfully transmitted to the transducers.

7 Claims, 9 Drawing Figures

STEREO PHONOGRAPH CARTRIDGE

BACKGROUND OF THE INVENTION

This invention relates to stereo phonograph cartridges in general, and more particularly to an improved stereo phonograph cartridge using a unique coupling method to permit direct coupling between stylus signal motions and transducers with minumum distortion of the record groove modulation.

The need for highly accurate phonograph cartridges which will faithfully reproduce the record groove modulation is well recognized. Over the years, the demands placed on cartridges have steadily been increased. Starting with the improved characteristics needed for long-playing records, then the further improvements needed for stereo records, these demands have steadily increased until now even more stringent requirements must be met for discreet four channel recordings. To provide faithful reproduction of record groove modulations, particularly on these latter types of records, it is necessary that the stylus have an extremely low mechanical impedence, allowing it to faithfully follow the complex and minute groove modulations at a very low stylus force. That these factors become particularly critical for performance over a frequency range of from 0 to 50 Khz and the associated reduction in stylus contact point radius required by discreet four channel recordings is easily recognized. For proper performance in such a discreet four channel system, the phonograph cartridge should have half the mechanical impedence and a linear transducer function up to twice the upper frequency limit as compared to the ordinary stereo performance. Thus, it is clear that improved cartridges are required if these newer discreet four channel recordings are to be reproduced with the same fidelity as ordinary stereo recordings now produced.

SUMMARY OF THE INVENTION

The present invention provides a cartridge which satisfies the requirements of a discreet four channel recording. Its application is not, however, limited thereto, since the improved design will also result in improved performance when used with conventional stereo or monaural long playing records. This improved performance is accomplished through the use of a coupling method which insures a practical and reliable structure with an extremely low mechanical impedence at the stylus, thus, allowing the stylus to faithfully follow the complex and minute groove modulations at very low stylus force. The coupling device insures that the pivot about which the stylus pivots becomes an essentially perfect pivot resulting in proper resolution of the two channels on the record. Typically, in prior art devices, a stylus bar is coupled to an imperfect pivot resulting in reduced channel to channel separation. To obtain the perfect pivot in the present invention, the stylus bar is coupled to a resolver having four points of force transmission. The two lower force points on the resolver are secured to elastomeric members attached to the base of the cartridge. The resolver is then positioned by using a flexible central pivot member under tension thus establishing the four force points; two on the lower elastomeric members, and two force points resting against respective right and left channel transducers. The force points at the transducers and at the elastomeric members are equal distances from the pivot point. The result of this construction is a perfect pivot causing motion to be properly resolved with an extremely high degree of channel to channel separation being maintained, all while operating at low tracking forces to further decrease the mechanical impedence at the stylus.

DETAILED DESCRIPTION OF THE PREFERRED EMBODIMENT

Before proceeding with a description of the preferred embodiment, some basic definitions will be given. The description which follows relates to performance on a 45 — 45 stereo record. Recorded signal motions at any instant of time are in a plane which passes through the stylus groove contact point and is inclined at 15° to the record surface. Thus, when the cartridge stylus bar is inclined at 15°, groove modulation motions are orthogonal to the longitudinal axis of the stylus bar. Furthermore, modulation motions are resolved into two orthoganal components, each normal to the unmodulated groove walls and at 45° to the record surface. These are the right and left signal components which are required to produce the original signal.

Figure 1:
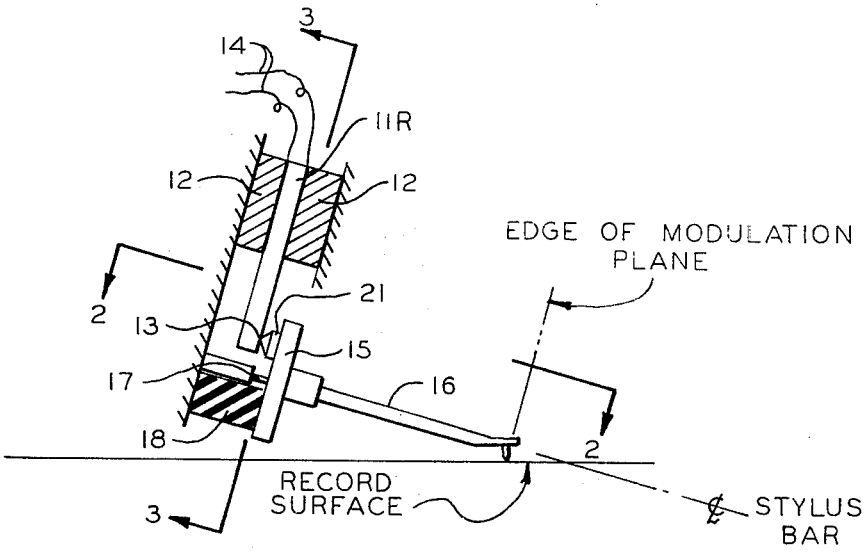
FIG. 1 is an elevation view illustrating, in schematic form, a cartridge arrangement according to the present invention.
Figure 2:
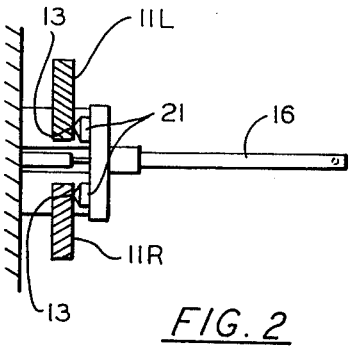
FIG. 2 is a plan view along section 2—2 of FIG. 1.
Figure 3:
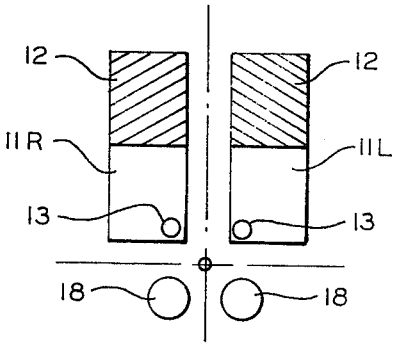
FIG. 3 is a view along section 3—3 of FIG. 1.
Figure 4:
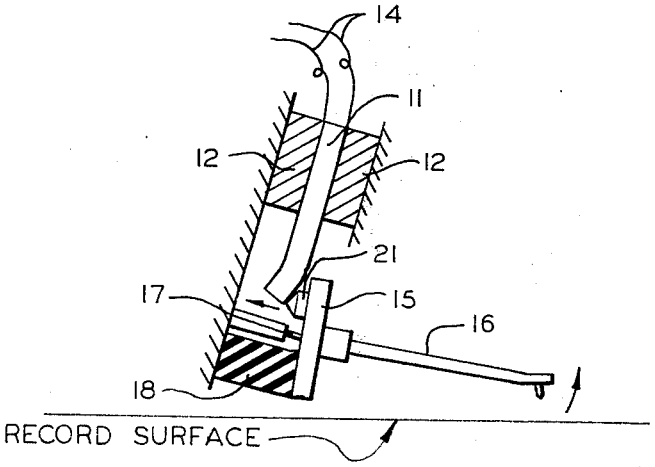
FIG. 4 is a view similar to that of FIG. 1, schematically illustrating deflection of a transducer in response to application of a force.
Figure 5:
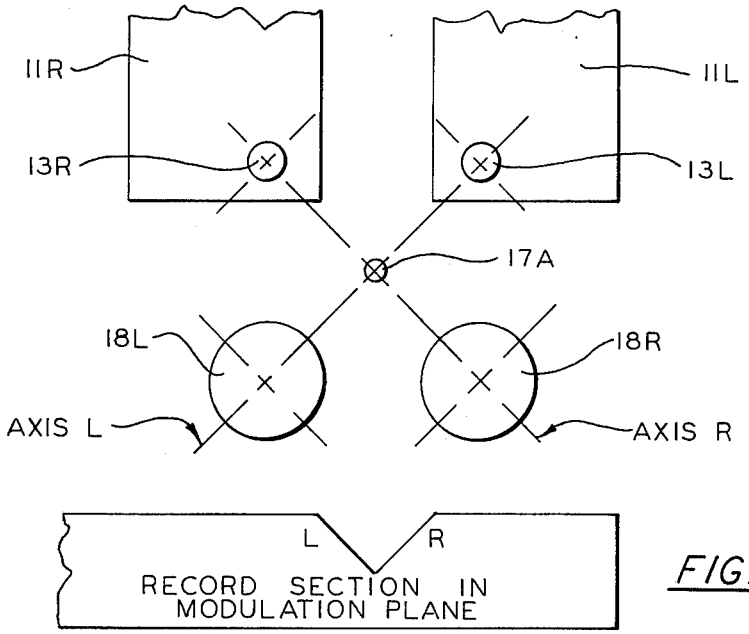
FIG. 5 is a view essentially the same as that of FIG. 3 illustrating the manner in which a perfect pivot is established by the arrangement of the present invention and which is helpful in understanding the manner in which forces are properly resolved.

FIG. 1 shows a simplified elevation view of the cartridge of the present invention, with FIG. 2 illustrating a plan view of section 2—2 and FIG. 3 the section 3—3. As illustrated, right and left transducers 11R and 11L are provided for converting mechanical motion to electrical signals. Typically, these transducers will be of the well known piezoelectric type such as that of those available from Gulton Industries or Vernatron Corp. Other types of transducers such as ceramic and electret transducers may equally well be used. In any case, a transducer having an extremely linear stress-voltage output characteristic will be employed. In addition, transducers having a high free-free beam resonance in excess of 40, KHz to prevent any interference with linear performance should be used. As illustrated, each of the transducers 11R and 11L is held between two elastomeric blocks 12 which are mounted to the base of the cartridge. The result of this type of mounting is illustrated by FIG. 4 which shows what happens when a force is applied at a coupling or force point 13. A stress proportional voltage is developed in the transducer 11 which is then transmitted to the amplifier load through electrical conductors 14 in conventional fashion. The aforementioned force is applied to the coupling point 13 through a coupling device or resolver 15 which has attached to its free end the stylus bar 16. As illustrated, the resolver 15 contains on its rear side, projections 21 which rest against the coupling points 13. The resolver 15 is secured to the base of the cartridge by a pivot anchor 17. The pivot anchor 17 is on the axial center line of the stylus bar 16. It is made of a flexible material and is placed under tension during assembly. Also provided are two elastomeric stabilizers 18. As illustrated, these are placed directly below the coupling points 13. The resolver geometry is best illustrated by FIG. 5, which is essentially the same view as is shown on FIG. 3. The points 13R and 13L (the transducer coupling points), and 18L and 18R (the force points on stabilizers 18), are equi-distant from the center of the pivot point 17A associated with pivot anchor 17. As a result, the tensile force placed on the pivot anchor 17 produces equal and opposing forces at the points 13R, 13L, 18R and 18L when the stylus is not in contact with the record. In other words, the sum of forces at the points 13R, 13L, 18R and 18L will be equal to the force produced by the pivot anchor. These forces will be in a direction opposite to the force exerted by pivot anchor 17 and will all be equal. The view shown is one which would be seen from the modulation plane looking along the longitudinal axis of the stylus bar. Thus, a right channel signal only will result in motion at 45° to the vertical and in a direction parallel to the axis designated R. This motion imparted to the stylus bar will cause the resolver 15 to rotate about the axis L producing stress in the transducer 11R and a release of stress in the stabilizer 18R. Because the rotation of the resolver 15 is about the axis L, there will be no relative motion of the points 13L and 18L. As a result, an electrical output is developed only in the right channel and the desired reproduction is accomplished. Similar results will occur for a left signal with rotation occuring about the axis R and the signal being faithfully reproduced. In general, any modulation motion will cause the resolution of that motion into the appropriate 45° right and left channel components as required.

Figure 6:
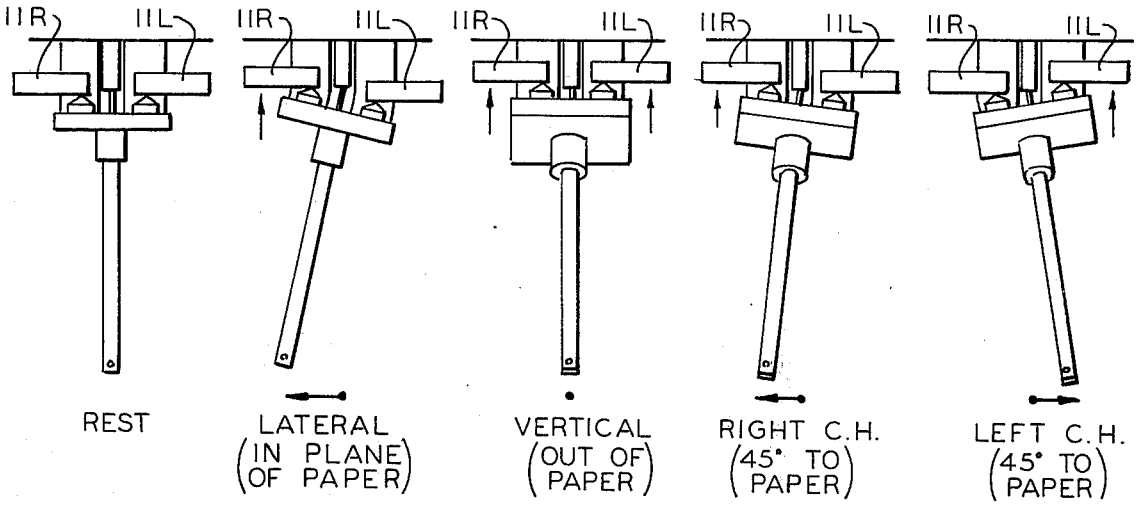
FIG. 6 is a series of views similar to the view of FIG. 2 illustrating the response to the present invention to various types of stylus motions.

FIG. 6 illustrates the relative movement of the transducer elements 11R and 11L for various modulation motions. As illustrated, at rest, the transducer 11R and 11L will be equally stressed. When the stylus is held in the record groove at rest, this verticle force at rest will result in two components of the force into the paper at the points 13R and 13L of FIG. 5. In addition, there will be an increase tensil force in the pivot anchor 7. However, these forces are small as compared to the tension applied to the pivot anchor during assembly and will not disturb the balance of forces in the structure and will not interfere with proper resolution of the stylus motion. Also illustrated on FIG. 6 is the result of lateral motion which will cause stressing of the transducers as illustrated, verticle motion which will cause equal stressing of both transducers to result in signals from both channels, and right and left channel motion of the type described above in connection with FIG. 5.

As noted above, it is the use of the symmetrical arrangement of the stabilizer force points and the transducer force points that results in the excellent resolution of motion at low forces. The importance of the stabilizers can best be illustrated by considering the case of a resolver 15 which operates without stabilizers 18. Assuming the pivot anchor 17 to establish a perfect pivot, i.e., one which allows rotation only about point 17A of FIG. 5, performance would be the same as described above. That is, all motions in the modulation plane are properly resolved at each transducer in 45° components of the signal motion, thereby producing correct output signals in each channel. However, a perfect pivot is difficult to obtain as a practical matter. If the pivot anchor 17 is not perfect, as is more likely, and translational motion at the pivot point occurs as a reaction to signal motions at the stylus, ideal resolution will not occur. For example, consider a right channel signal. Motion at the stylus will be parallel to the axis R as described above. However, with an imperfect pivot, the pivot anchor is elastic, permitting the pivot pin point 17A to move out of the paper as viewed on FIG. 5. As a result, the resolver 15 will now rotate about an axis between the axis L and point 13R. Transducer 11R will be stressed less than is required for linear transduction and motion will occur at point 13L, reducing the channel-to-channel separation.

Thus, the stabilizers 18 provide a balanced force structure so that the tensil force in a practical pivot may be made large as compared to the signal forces. The resulting symmetrical forces prevent translational motions of the pivot point 17A. This design provides a practical, perfect pivot at the point 17A and proper 45° to 45° resolving reaction to stylus signal motions.

Successful models of the above described cartridge utilizing extremely light, relatively rigid stylus 16 and resolver 15 assemblies, and provide direct coupling between the stylus and the transducers, providing all resolution requirements for stereo phonograph reproduction have been produced. Models have been tested in which the stylus and resolver assemblies weigh under $2 \times 10^{-3}$ grams. The illustrated lever ratio of stylus to pivot to coupling point distance which is approximately 10 to 1 reduces the inertial effect at the stylus to a negligible factor. This large lever ratio also increases stylus compliance to permit tracking forces on the order of 1 gram.

Construction of the cartridge may be carried out using simple well known processes. The stylus resolver may be made by molding a rigid plastic material in the required shape. The elastomeric blocks, which may comprise a rubber, such as buytl rubber, or mixed rubber components, may similarly be molded using well known rubber molding techniques. Attachment of the elastomeric material 12 and 18 may be done mechanically by providing suitable inserts in the base of the cartridge or may be accomplished by cementing of the elastomeric material. The stabilizers should be made from elastomeric material which is selected to provide appropriate critical damping effects. Because of the manner in which the cartridge of the present invention is constructed using the stabilizers 18, the tensioning of the pivot anchor 17, and its alignment is not particularly critical and thus, the practical production of the cartridge is much simpler than the production of those of the prior art.

Construction of the present invention also lends itself to a simple replaceable stylus assembly design. The stylus bar 16, resolver 15, stabilizers 18 and pivot anchor 17, may be constructed on a suitable removable portion of the base. This portion will then comprise a replaceable unit which may be easily inserted into the cartridge providing the required tension in the pivot, and without requiring additional adjustment or causing any detrimental effects to cartridge performance because of alignment variations because the resolver and pivot keep the proper alignment. This construction is illustrated by FIG. 7 which shows a complete view of the finished cartridge.

Figure 7:
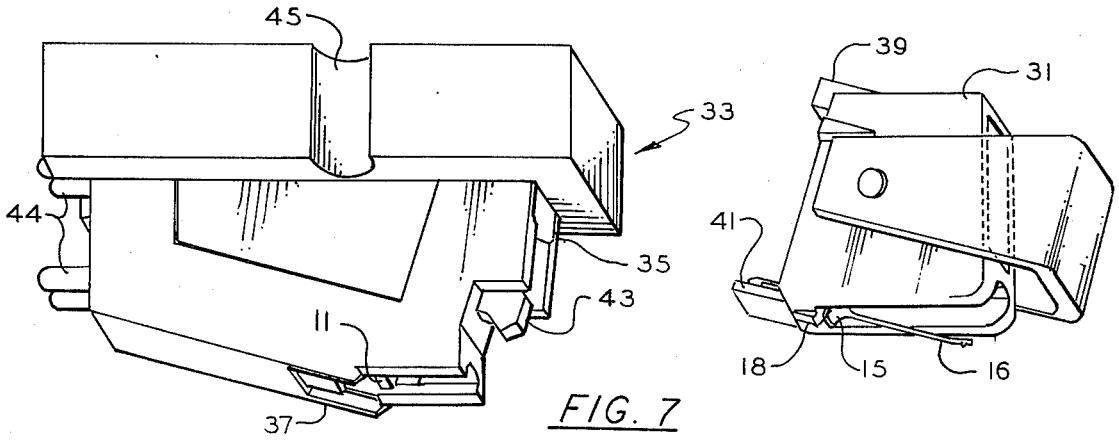
FIG. 7 is a perspective view of a cartridge according to the present invention showing a replacement unit portion of the cartridge separated from the main portion of the cartridge.

The view of FIG. 7 illustrates the replacement unit separated from the remainder of the body of the cartridge. As shown, the resolver 15, pivot anchor 17 and stylus 16, along with the elastomer blocks 18 are mounted, within a replaceable member 31. The major portion of the cartridge designated 33 in general, contains an upper slot 35 and a lower slot 37 which match, respectively, projections 39 and 41 on the replacement unit. A projecting catch 43 is formed in the cartridge portion 33 over which a spring clip will snap to hold the replacement unit securely in place and will provide tensile force in the pivot anchor. A small portion of the transducer, which will contact the upper portion of the resolver 15, is also visible. At the rear of the cartridge 33 are provided electrical plug 44 so that the cartridge may be plugged into a phonograph arm in conventional fashion. The cartridge will also be made in a suitable shape including means such as indentation 45 to permit it to be securely mounted to the phonograph arm in conventional fashion.

Figure 8:
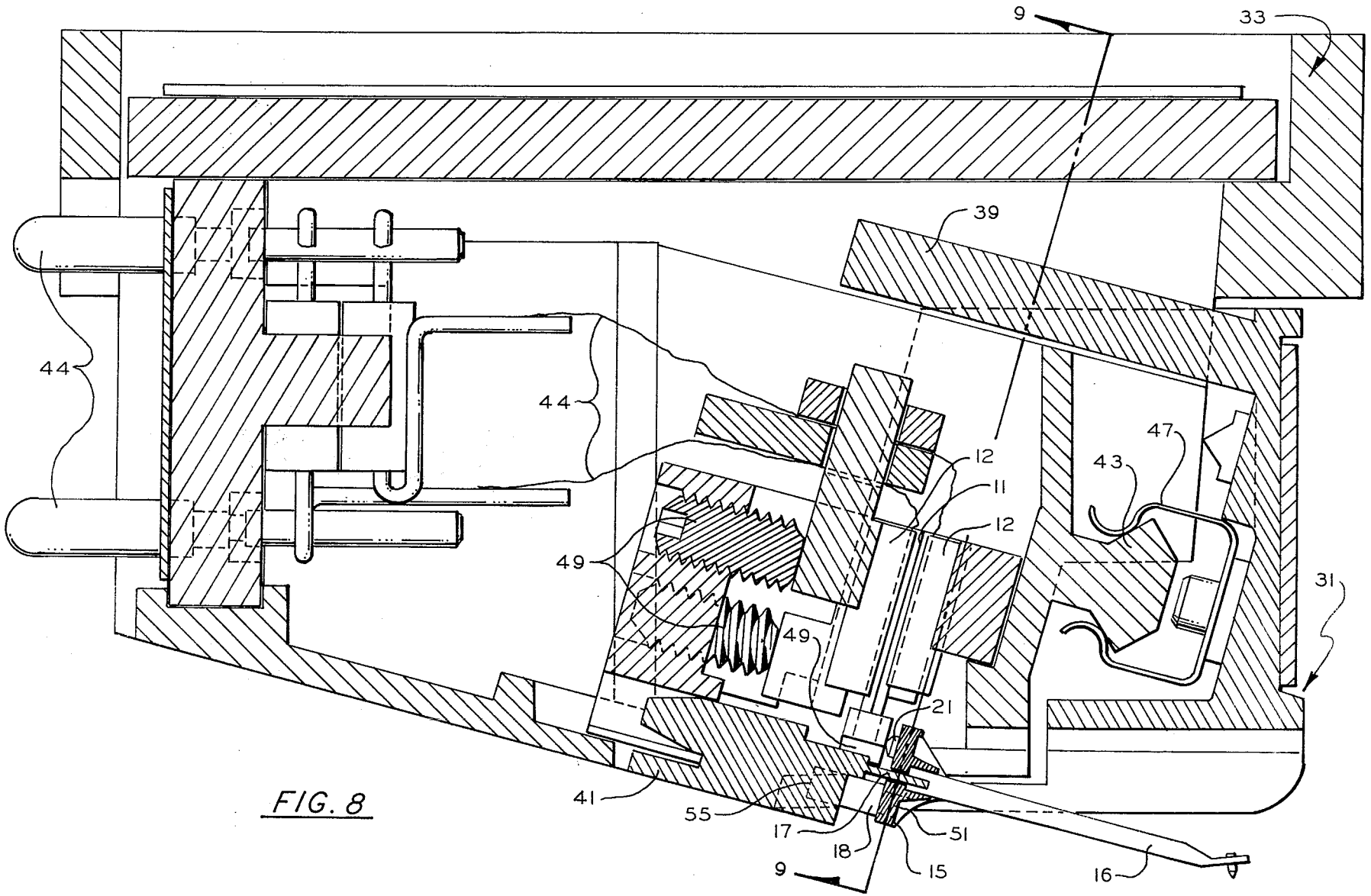
FIG. 8 is a cross-sectional elevation view of the cartridge of FIG. 7 with the replacement unit attached to the main body of the cartridge.

FIG. 8 shows a cross sectional view of the cartridge arrangement of FIG. 7, with the replacement unit base 31 secured into the main portion 33 of the cartridge. As described above, the projections 41 and 39 fit into slots in the body 33 of the cartridge provided therefor. The projection 43 engages a clip 47 to hold the replacement unit 31 in place. Clip 47 will be secured to the base of the replacement unit in conventional fashion, using screws or the like. Also shown on this figure are the wires 14 leading from the transducers 11 to the plugs 44 at the rear of the cartridge. Note that the resolver 15, pivot anchor 17 and elastomer blocks 18 are all preassembled into the replacement unit, thereby permitting proper tensioning of the pivot anchor 17 when tightly inserted under the influence of the clip 47, which will cause the projection portion 41 to abut against a prealigned edge of the cartridge, proper stressing of all portions of the arrangement will result. Also shown are set screws 49 which may be used for adjusting the stressing and position of the pizoelectric members 11 through their associated elastomeric blocks 12 during factory assembly.

This view also illustrates a modification of the coupling point arrangement described above. As shown, the transducers 11 have caps 48 on their ends which contact the projections 21 of resolver 15. This, in no way, affects the balanced force arrangement with the caps being used only as protective devices for the delicate transducer material.

Figure 9:
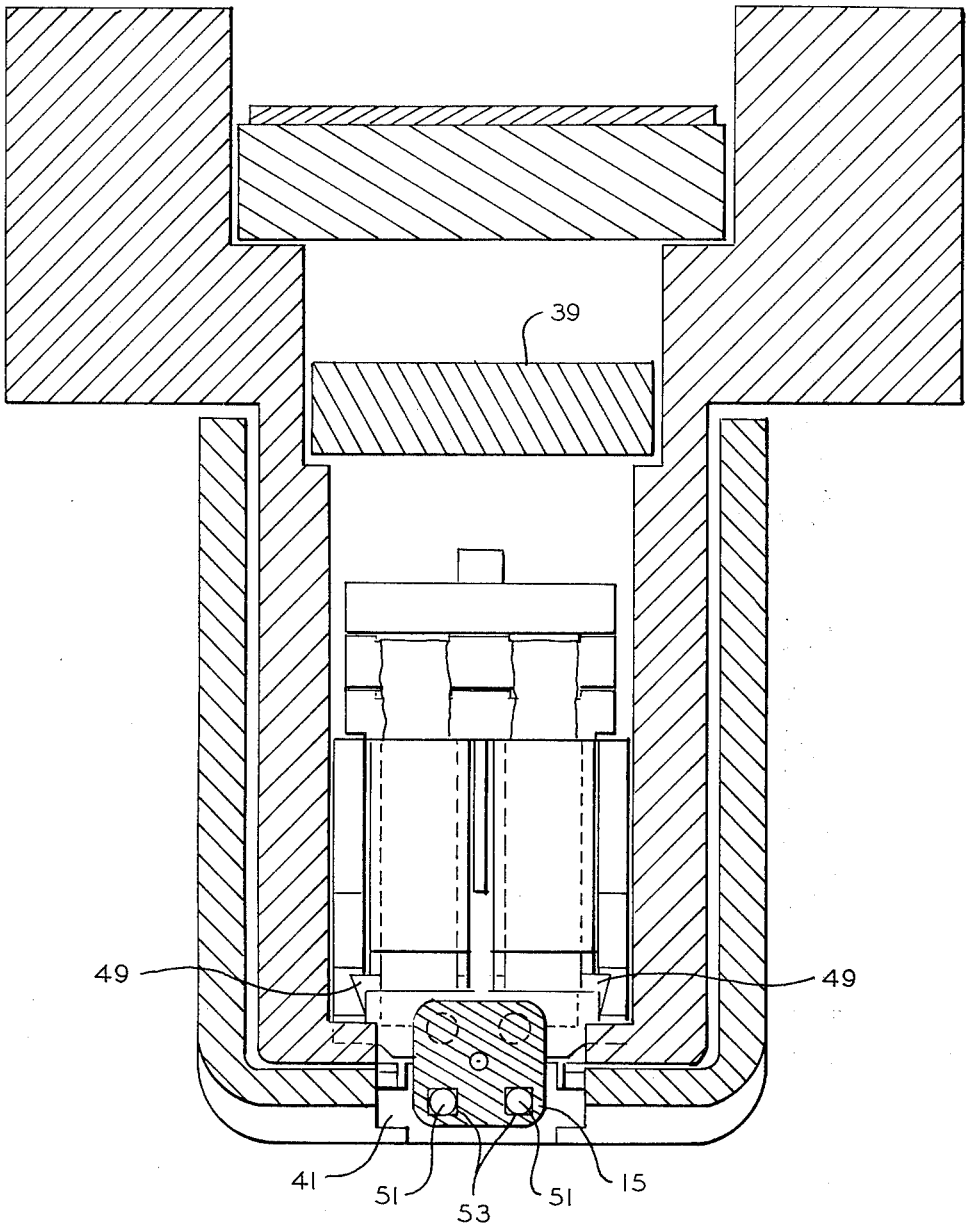
FIG. 9 is a sectional view along the line 9—9 of FIG. 8.

These caps 48 are also shown on FIG. 9 which is taken along the section 9—9 of FIG. 8. From this figure and from FIG. 8, it can be seen that the stabilizers 18 are formed with projections 51 on their ends which fit into appropriate holes 53 in the resolver 15. Also shown on FIG. 8 is a recess 55 in a portion of the base of the replaceable member 31 into which the stabilizers 18 are inserted.

Thus, an improved phonograph cartridge which permits the faithful reproduction of four channel stereo has been shown. Although a specific embodiment has been illustrated and described, it will be obvoius to those skilled in the art that various modifications may be made without departing from the spirit of the invention which is intended to be limited solely by the appended claims.

What is claimed is:

1. An improved stereo phonograph cartridge comprising:

a. a base;

b. first and second piezoelectric transducers;

c. first and second individual elastomeric means mounting said first and second transducer to said base depending downward in a cantilevered manner in horizontal spaced relationship;

d. first and second separate elastomeric stabilizers mounted to said base in horizontal spaced relationship with each other and directly below said first and second transducers;

e. a resolver having four connecting points contacting respectively to said first and second transducers and said first and second stabilizers;

f. a pivot anchor coupling said resolver in a tensioned manner to said base, said pivot anchor being attached to said resolver at a point which is equidistant from each of said four connecting points; and g. a stylus bar extending from said resolver along the axis of said pivot anchor.

2. Apparatus according to claim 1 wherein said transducers are electret transducers.

3. Apparatus according to claim 1 wherein said elastomeric members and said stabilizers are made of butyl rubber.

4. An improved stereo cartridge comprising:

a. a main base portion;

b. first and second piezoelectric transducers;

c. individual elastomeric means separately mounting said first and second transducers to said main base portion depending downward in a cantilevered manner in horizontal spaced relationship;

d. a replaceable base portion;

e. first and second separate elastomeric stabilizers mounted to said replaceable base portion in horizontal spaced relationship with each other;

f. a resolver, having four connecting points;

g. a pivot anchor coupling said resolver in a tensioned manner to said replaceable base portion such that two of said four contacting points contact said first and second stabilizers, said pivot anchor being attached to said resolver at a point which is equidistant from each of said four connecting points;

h. a stylus bar extending from said resolver along the axis of said pivot anchor; and i. means for coupling said main base portion and said removable base portion so that the remaining two of the four connecting points of said resolver contact said first and second transducers with said first and second stabilizers thereby being directly below said first and second transducers, whereby said resolver may be prestressed when mounted to said replaceable base portion allowing replacement of said replaceable base portion, stabilizers, resolver, and stylus bar when the stylus of said bar becomes worn.

5. Apparatus according to claim 4 wherein said means for coupling comprised at least one recess in said main base portion and a projection from the front thereof and a projection on said replaceable portion sized to slide into said recess and an internal clip on said replaceable base portion to clip over said projection on said main base portion, thereby retaining said replaceable portion in place when inserted into said main base portion.

6. Apparatus according to claim 5 wherein said stabilizers contain circular projecting portions on the front thereof which fit into matching holes formed in said resolver at the stabilizer contact points.

7. Apparatus according to claim 6 wherein said resolver is a molded-plastic part.

* * * * *